United States Patent [19]

Goodwin

[11] 4,260,331

[45] Apr. 7, 1981

[54] ROOT ATTACHMENT FOR A GAS TURBINE ENGINE BLADE

[75] Inventor: John R. Goodwin, Ockbrook, England

[73] Assignee: Rolls-Royce Limited, London, England

[21] Appl. No.: 76,436

[22] Filed: Sep. 17, 1979

[30] Foreign Application Priority Data

Sep. 30, 1978 [GB] United Kingdom ..... 38835/78

[51] Int. Cl.[3] ..... F01D 5/30

[52] U.S. Cl. ..... 416/219 R

[58] Field of Search ..... 416/219 R, 220 R, 241 B, 416/248

[56] References Cited

U.S. PATENT DOCUMENTS

| | | | |
|---|---|---|---|
| 3,045,968 | 7/1962 | Willis | 416/219 R |
| 3,079,681 | 3/1963 | Fentiman | 416/219 R |
| 3,908,447 | 9/1975 | Salt | 416/219 R |

FOREIGN PATENT DOCUMENTS

| | | | |
|---|---|---|---|
| 240283 | 4/1956 | Switzerland | 416/219 R |
| 677142 | 8/1952 | United Kingdom | 416/219 R |

*Primary Examiner*—Leonard E. Smith

[57] ABSTRACT

A root attachment of the firtree type for a blade of a gas turbine engine. The shape of the root falls within certain closely defined parameters which have been found to give optimum properties to the root. Thus the arrays of teeth forming the root diverge at 35°±1°, the pair of angled faces making up each tooth are at an angle of 60°±1° to each other, and each outer tooth face is at 45°±2° to a normal to the central plane of the root. Also the ratio of the tooth height to the radius of the radiused portions lies in the range 1.5:1 to 2:1.

6 Claims, 3 Drawing Figures

ROOT ATTACHMENT FOR A GAS TURBINE ENGINE BLADE

Figure 1:
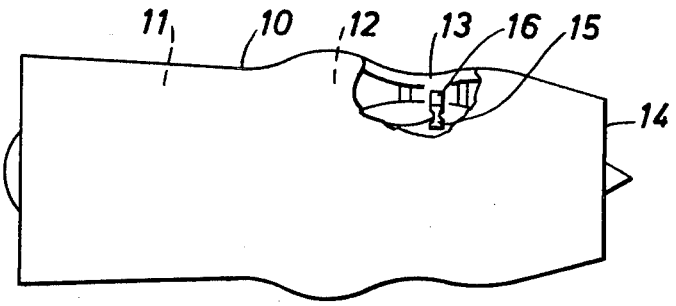

This invention relates to a root attachment for a blade of a gas turbine engine.

As is well known in the art, the aerofoil blades of a gas turbine, both in the compressors and turbines, are normally carried from a disc or drum or similar rotor structure. The engagement between the blades and the supporting rotor is a crucial part of the design of any such rotor; it must sustain the loads carried from the blade to the rotor without failure, and it must be overall as small as possible so as to reduce the size of the blade root and disc rim to a minimum.

In the past, a variety of root attachments have been proposed and used. Normally these have been of the general type in which the root has projections of one kind or another which engage with undercut surfaces of a corresponding groove in the rotor periphery. The grooves may extend axially from one fact to another of the rotor, or alternatively may extend circumferentially of the rotor periphery, and two particularly widely used members of the former class are called 'dovetail' and 'firtree' root attachments after the approximate cross-section of the blade root provided in each case.

The root attachments used in the past have not been entirely successful, particularly in enabling blades of cast superalloys to be securely retained over a long service life.

The present invention provides a root attachment in which the stress in the blade and rotor are optimised to achieve better reliability for the same weight of attachment, or a lighter attachment if the same reliability is sufficient.

According to the present invention a root attachment for a blade of a gas turbine engine comprises a 'firtree' root on the blade engaging with a correspondingly shaped groove formed in the rotor to which the blade is attached, the root having a number of projections or teeth each comprising a pair of angled faces joined by a radiused portion and each projection or tooth being joined to the next adjacent projection or tooth by a radiused portion, the projections or teeth being disposed in two plane arrays symmetrical about a plane through the blade longitudinal axis and diverging from the innermost part of the root at an angle of $35° \pm 1°$, each said part of angled faces being disposed at an angle of $60° \pm 1°$ to each other and the outermost of each pair of faces lying at an angle of $45° \pm 2°$ to a normal to said plane, the ratio of the tooth height measured at right angles to said plane, to the radius of said radiused portions lying in the range 1.5:1 to 2:1.

In one embodiment there are five of said projections or teeth in each said plane array, although this number may of course vary according to the blade retention requirement and the depth of disc rim available.

In one embodiment the ratio of the tooth height to the radius of the radiused portion is 1.58:1.

The invention is particularly suitable for attaching blades of a cast nickel-based superalloy to a rotor of a wrought or powder formed nickel-based superalloy.

Figure 2:
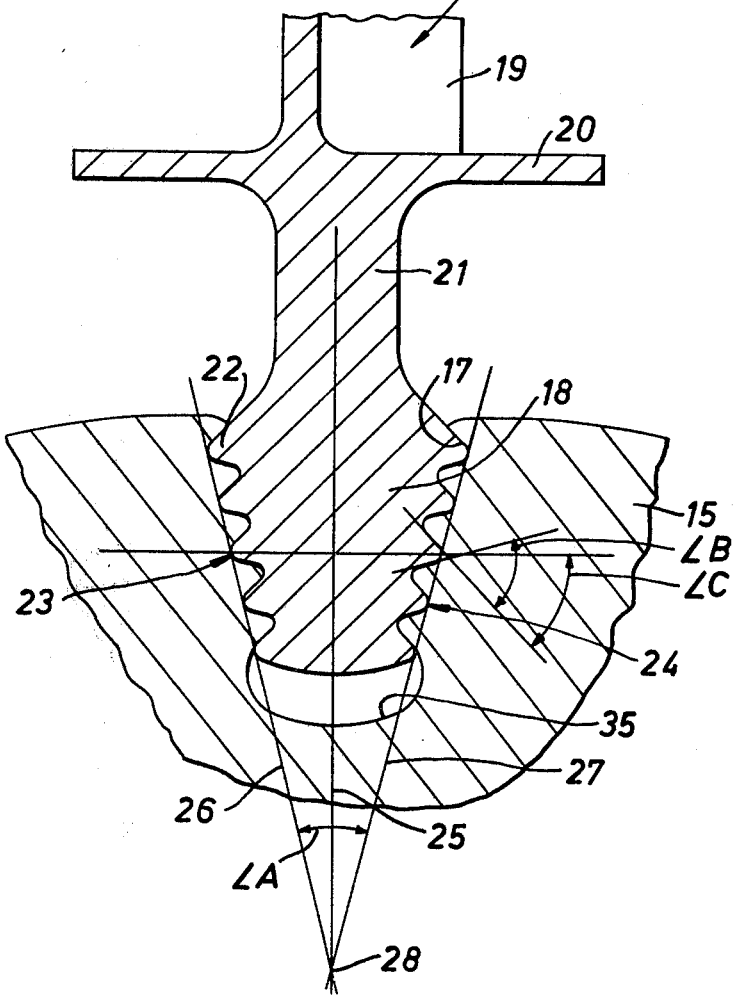
Figure 3:
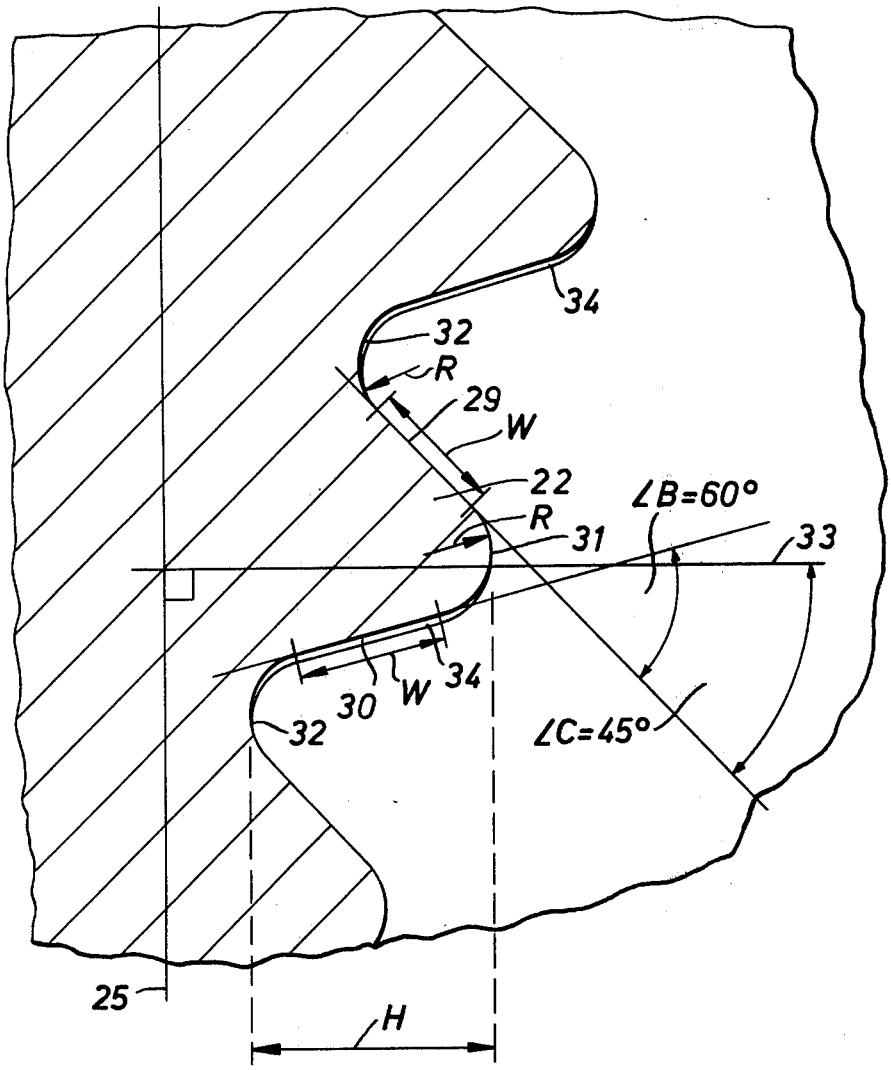

The invention will now be particularly described, merely by way of example, with reference to the accompanying drawings in which:

FIG. 1 is a partly broken-away view of a gas turbine engine having a root attachment in accordance with the invention, FIG. 2 is an enlarged section through a blade and rotor portion of the engine of FIG. 1 and in accordance with the invention, and, FIG. 3 is a further enlargement of part of the section of FIG. 2.

In FIG. 1 there is shown a gas turbine comprising a casing 10, within which are mounted a compressor 11, a combustion chamber 12, a turbine 13 and a final nozzle 14. Operation of the engine overall is conventional and is therefore not described herein.

The casing 10 is cut away in the vicinity of the turbine 13 to expose to view the turbine rotor disc 15 and its associated rotor blades 16. As is usual in gas turbines, the blades 16 are not integral with the rotor disc 15 but are held in axially extending (but not parallel with the disc axis) slots 17 by the engagement therein of correspondingly shaped roots 18. The blades 16 are mounted in an angularly spaced apart circumferential row on 'stage' on the disc 15.

FIG. 2 shows an enlarged cross-section through the mid-section of one of the blades 16 and the associated area of the disc 15, the plane of the section being perpendicular to the disc axis. Visible in section are the aerofoil 19, the platform 20, the root shank 21 and the root 18 itself.

As is known in the art, the engagement between the root 18 and its correspondingly shaped slot 17 in the disc holds the blade in position on the disc. In accordance with the invention the root 18 is therefore provided with ten teeth 22, all teeth being similar in cross-sectional shape. These teeth are disposed in two plane arrays 23 and 24, of five teeth each, the arrays being symmetrical about the central plane 25 of the blade.

In FIG. 2 the planes 26 and 27 of the arrays are shown, and it will be seen that these planes intersect in a line whose position on the plane 25 is shown at 28. The planes 26 and 27 of the arrays define between them an included angle A (the 'wedge' angle ) which, in the present invention, is 35° with a tolerance of $\pm 1°$ for the optimum result.

It will be appreciated that the teeth 22 have a longitudinal extent equal to that of the entire root; that is, they extend into and out of the paper in the orientation of FIG. 2. However, the shape of the teeth remains constant throughout their longitudinal extent and the further enlarged view of FIG. 3 enables this shape to be understood more easily. It should be understood that all the teeth have the same profile so that although only one tooth is described with reference to FIG. 3, all the other teeth will in fact be similar.

The tooth 22 is seen to comprise an outer and an inner angled face 29 and 30 respectively, the faces being joined together by a convex radiused portion 31 and each face being joined to a face of the next adjacent tooth (where there is one) by a concave radiused portion 32. The angle between these faces 29 and 30 (the 'included angle') is shown at B, while the inclination of the face 29 to a line 33 normal to the plane 25 (the 'flank angle') is shown at C. In the present embodiment the angle B is 60° with a tolerance of $\pm 1°$ while the angle C is 45° with a tolerance of $\pm 2°$ for best results.

The only remaining factors required to completely define the shape of the root 18 are the sizes of the faces 29 and 30 and the radiused portions 31 and 32. In the present embodiment the widths W of the faces 29 and 30 are equal at 40 units of measurement while the radii R of the portions 31 and 32 are again equal at 24 units. It is in fact more convenient to define the size of the teeth by the tooth height overall, measured at right angles to the plane 25. This dimension H is related to the width W by a geometrical relationship, and in the present instance H is 38 units in dimension. Hence the ratio of H to R is 1.58:1 in the present case. We have found that to maintain optimum properties the ratio H:R should lie in the range 1.5:1 to 2:1.

The shape of the root 18 is therefore completely determined by the parameters defined above. The root slots 17 will be of similar shape, but with certain modifications. Thus there is a clearance at 34 between the face 30 and its equivalent in the disc slot, so as to enable the blade to be assembled in the slot. Also a bucket groove 35 is provided beneath the inner extent of the root 18, this groove providing access for cooling air to passage (not shown) in the blade root itself. Finally use may be made of 'differential pitch' between the root teeth and corresponding slot grooves to ensure that loads are shared between the teeth properly.

It should be noted that the embodiment above has arrays of five teeth of specific dimensions. It would be possible, without departing from the invention, to vary these dimensions considerably and to vary the number of teeth to suit a particular application. Thus roots with six or eight teeth would for instance be useful, and as long as the shape of the teeth as defined above is retained, the benefit of the invention will be obtained at least in part.

To demonstrate the improvement obtained by the invention, calculations have been made to determine the crushing stress on the material in between one of the faces 29 and its corresponding root face, and the combined peak stress occurring anywhere in the root for different configurations. These are tabulated below:

| Ex No. | Teeth | ∠A | ∠B | ∠C | H (ins) | R (ins) | H/R | Crushing Stress Tons/sq in | Peak Stress Ions/sq in |
|---|---|---|---|---|---|---|---|---|---|
| 1 | 4 | 35° | 60° | 45° | 0.047 | 0.018 | 2.61 | 21.5 | 53.1 |
| 2 | 4 | 35° | 60° | 45° | 0.047 | 0.026 | 1.81 | 23.9 | 47.3 |
| 3 | 4 | 35° | 60° | 45° | 0.043 | 0.026 | 1.65 | 27.3 | 46.9 |
| 4 | 5 | 35° | 60° | 45° | 0.040 | 0.018 | 2.22 | 21.3 | 49.6 |
| 5 | 5 | 35° | 60° | 45° | 0.038 | 0.024 | 1.583 | 25.4 | 44.2 |
| 6 | 5 | 35° | 60° | 45° | 0.036 | 0.026 | 1.385 | 28.9 | 42.3 |
| 7 | 7 | 40° | 54° | 45° | 0.027 | 0.012 | 2.25 | 23.2 | 57.0 |
| 8 | 7 | 40° | 54° | 45° | 0.027 | 0.015 | 1.80 | 25.1 | 52.0 |

It should be explained that the crushing stress should be kept below about 28 tons/sq in while the peak stress should not exceed 50 tons/sq in. Thus example 1 which is outside the present invention has a very high value of combined peak stress; example 2 and 3 are within the invention and have lower values of peak stress and values of crushing stress still within reasonable limits.

Of the 5 tooth root forms, example 5 is within the invention while examples 4 to 6 are outside. In example 4 the peak stress is almost 50 tons/sq in and is just on the limit of acceptability, example 5 corresponds with the embodiment described and shows a very good balance of low peak stress and reasonable crushing stress. In example 6 the peak stress is very low, but the crushing stress is over the limit of acceptability.

Finally, examples 7 to 8 are both outside the range of the invention because of the values of angles A and B. It will be noted that in both these cases the peak stresses are outside the acceptable limit, but even so the values for example 8 which has a ratio H/R within the specified range are much better than those for example 7.

I claim:

1. A root attachment for a blade of a gas turbine engine comprises a firtree root on the blade, and a rotor having a correspondingly shaped groove formed therein and with which the root engages, the root having a plurality of teeth each comprising a pair of angled faces joined by a convex radiused portion and concave radiused portions which join each tooth to the next adjacent teeth, the teeth being disposed in two plane arrays symmetrical about a plane through the longitudinal axis of the root and diverging from the innermost part of the root at an angle of 35°±1°, each said pair of angled faces being disposed at an angle of 60°±1° to each other and the outermost of each pair of faces lying at an angle of 45°±2° to a normal to said plane, the ratio of the tooth height measured at right angles to said plane, to the radius of said radiused portions lying in the range 1.5:1 to 2:1.

2. A root attachment as claimed in claim 1 and in which there are five of said teeth in each said plane array.

3. A root attachment as claimed in claim 1 and in which said ratio of the tooth height to the radius of the radiused portions is 1.58:1.

4. A root attachment as claimed in claim 1 and in which the blade comprises a cast superalloy.

5. A root attachment as claimed in claim 4 and in which the rotor comprises a wrought superalloy.

6. A root attachment as claimed in claim 4 and in which the rotor comprises a powder formed superalloy.

* * * * *